US005186113A

United States Patent [19]

Green

[11] Patent Number: 5,186,113

[45] Date of Patent: Feb. 16, 1993

[54] INVERTED TUFTING MACHINE NEEDLE DRIVE AND STROKE ADJUSTMENT

[75] Inventor: Jerry T. Green, Hixson, Tenn.

[73] Assignee: Tuftco, Inc., Chattanooga, Tenn.

[21] Appl. No.: 784,973

[22] Filed: Oct. 30, 1991

[51] Int. Cl.[5] ..... D05C 15/20

[52] U.S. Cl. ..... 112/80.42

[58] Field of Search ..... 112/80.42, 80.4, 221, 112/98; 66/825, 204

[56] References Cited

U.S. PATENT DOCUMENTS

| | | | |
|---|---|---|---|
| 1,855,175 | 4/1932 | Braudes | 112/80.42 X |
| 2,977,905 | 4/1961 | Cobble . | |
| 3,633,523 | 1/1972 | Card | 112/80.42 |
| 3,919,952 | 11/1975 | Lund | 112/80.42 |
| 4,301,751 | 11/1981 | Caylor . | |
| 4,665,845 | 5/1987 | Card . | |
| 4,834,005 | 5/1989 | Bagnall . | |
| 4,860,673 | 8/1989 | Ward et al. | 112/80.42 X |
| 4,860,674 | 8/1989 | Slattery | 112/80.42 |

*Primary Examiner*—Andrew M. Falik
*Assistant Examiner*—Paul C. Lewis
*Attorney, Agent, or Firm*—Douglas T. Johnson

[57] ABSTRACT

A tufting machine in which a driveshaft is connected by a stroke adjustment means to a rocker shaft for reciprocally driving push rods connected to the needlebar, wherein the driveshaft is located relatively above the rocker shaft and positioned centrally in a high speed head whereby the tufting machine operates in excess or 1,200 rpm.

8 Claims, 4 Drawing Sheets

INVERTED TUFTING MACHINE NEEDLE DRIVE AND STROKE ADJUSTMENT

BACKGROUND OF THE INVENTION

The present invention relates to an improved configuration for connecting the needle drive and stroke adjustment to the main shaft of a tufting machine, and more particularly a "dial type" adjusting mechanism tufting machine.

In dial type adjusting mechanism tufting machines, adjustment of the stroke of the tufting machine is usually made by changing the point of attachment of an eccentric rod to a drive lever through which an oscillating motion from an eccentric cam mounted on a rotating driveshaft is applied to a rocker-type or oscillating shaft, the needles being reciprocally driven by push rods connected to the rocker shaft. Mechanisms of this type are well known in the art, examples being illustrated in U.S. Pat. Nos. 2,977,905 and 3,881,432. FIGS. 6 and 7 U.S. Pat. No. 2,977,905 are reproduced in the accompanying FIGS. 1 and 2 for comparison purposes. Needle stroke changes are performed at each end of a dial type machine and are usually accomplished by moving the point of attachment from an eccentric rod to a drive lever, the drive lever having an arcuate slot with a center curvature coinciding with the geometric center of the eccentric cam when the cam is at bottom dead center.

Several inherent disadvantages have been encountered in previous dial type adjusting mechanisms. The first problem concerns the nonuniform nature of the forces applied to the needle mechanism arising from the changes in leverage of the slotted drive lever upon adjustment. A second problem related to the nonuniform nature of the forces is the increased vibration at high speeds where the drive lever and needle mechanism are raised and lowered in unison rather than in opposition to one another. A third problem is that the slotted drive lever or its connection with the eccentric rod can be structurally intolerant of the forces transmitted by high speed tufting machines. A fourth problem is crowding at the ends of the driveshaft, a position that usually serves as the drive mechanism not only for the needle drive, but also for the backing feed drive, the yarn feed drive, the knife rocker shaft, the looper rocker shaft or jack shaft, and one or more optional attachments. A fifth problem is that the driveshaft has heretofore been mounted proximate to the side or bottom of the machine head, making it difficult or impossible to use counterweights to reduce the vibrations which occur at high speeds.

As a result of the above-mentioned disadvantages, it has proven difficult to manufacture a dial type tufting machine which would operate reliably without excessive vibration at speeds in excess of 800 revolutions per minute. Because the dial type tufting machines are less expensive to manufacture and maintain than the high speed machines of the type illustrated in U.S. Pat. Nos. 3,839,972; 3,857,345; and 4,515,096, considerable effort has been devoted to improving the performance of the dial type machines. Examples of such improvements include the use of an adjustable eccentric drive and eccentric rod connecting to an unslotted drive lever in the place of the drive lever with an arcuate slot to adjust the needle stroke as claimed in U.S. Pat. No. 4,834,005, as well as the use of individual needlebar drive assemblies with demountable stroke cams and connecting rods as claimed in U.S. Pat. No. 4,665,845.

In all dial type machines heretofore manufactured, the driveshaft has been located substantially below the rocker shaft. This relationship is inverted in the present invention, which leads to a substantial increase in the operating speed of the tufting machine.

SUMMARY OF THE INVENTION

It is the primary object of this invention to provide a configuration for the main driveshaft, the needle rocker shaft, and the stroke adjustment means in a dial type tufting machine that will:

(1) improve the balance of the needle drive mechanism and thereby promote smoother operation of the machine;

(2) permit the use of counterweights on the main driveshaft for the reduction of vibration;

(3) provide a linkage that is structurally able to withstand the forces transmitted during high speed operation of the tufting machine;

(4) alleviate the crowding at the ends of the main driveshaft to facilitate maintenance and the attachment of accessories; and (5) attain operating speeds in excess of 1,200 rpm.

According to a preferred feature of the invention, the main driveshaft is raised to a location parallel to and above the needle rocker shaft, and both shafts are mounted in a high speed tufting machine head.

DESCRIPTION OF THE PREFERRED EMBODIMENTS

Figure 2:
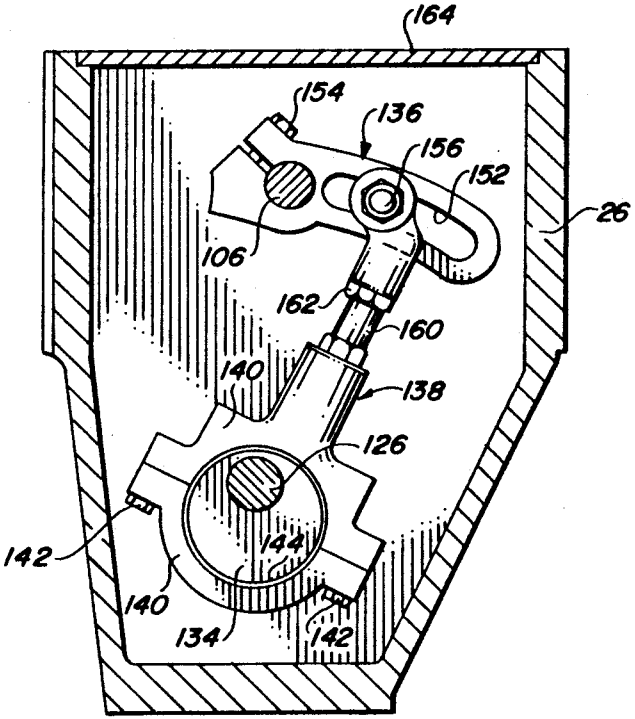
FIG. 2 (PRIOR ART)
FIG. 2 illustrates an embodiment of the prior art (FIG. 7 of U.S. Pat. No. 2,977,905).
Figure 1:
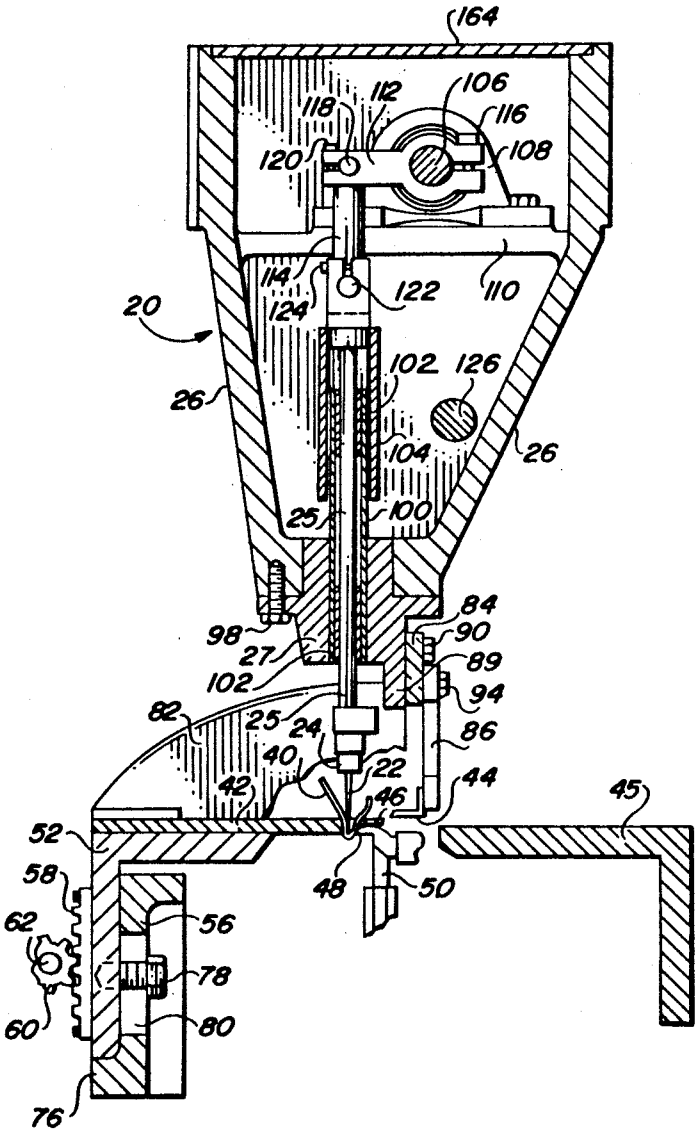
FIG. 1 (PRIOR ART)
FIG. 1 illustrates an embodiment of the prior art (FIG. 6 of U.S. Pat. No. 2,977,905).
Figure 3:
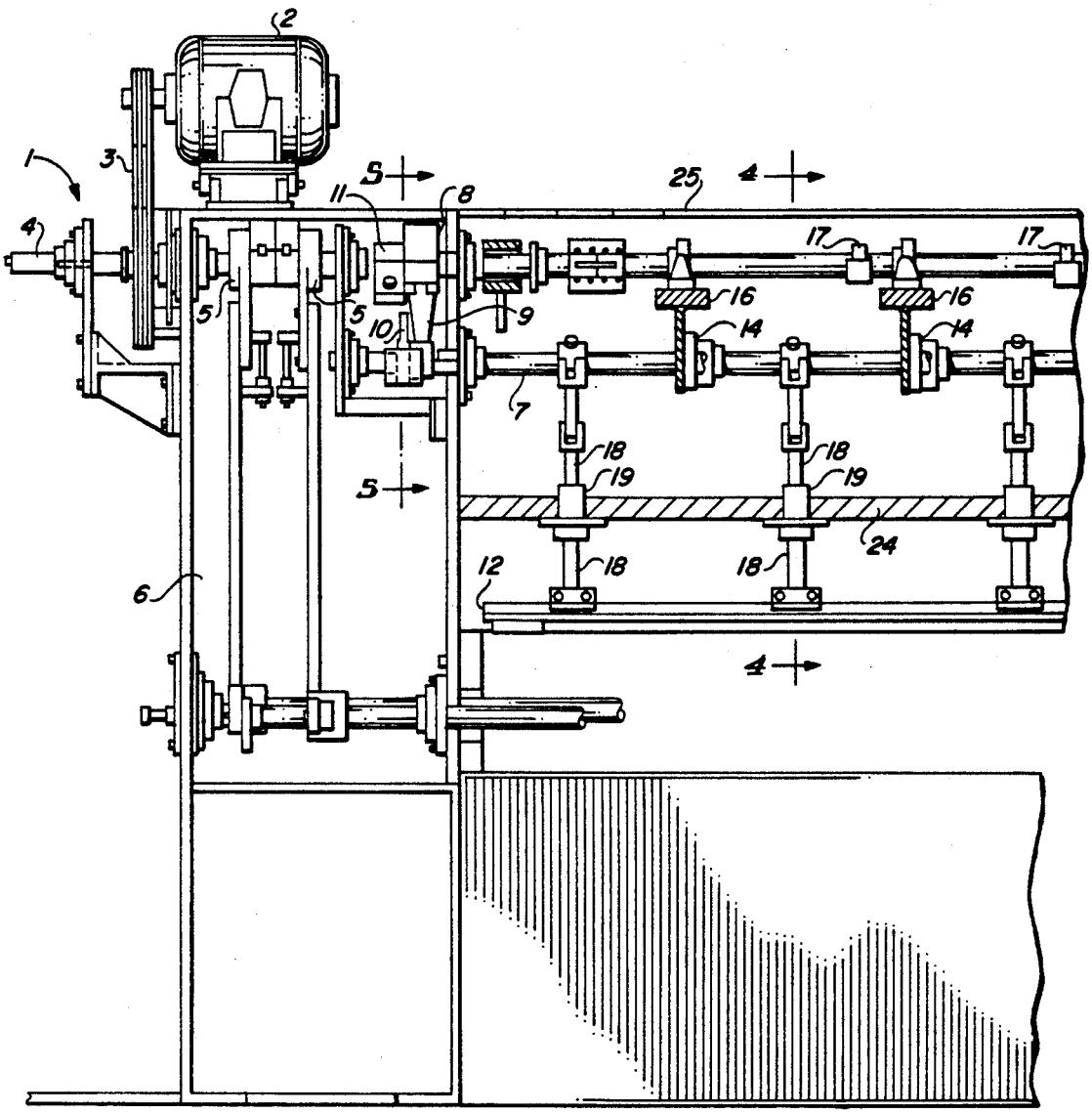
FIG. 3 illustrates a partial sectional side view of a tufting machine embodying the present invention.

Referring now in detail to the embodiment chosen for the purpose of illustrating the present invention, FIG. 3 shows a dial type tufting machine 1 with power source 2 and belts 3 to a main driveshaft 4. The main driveshaft 4 may serve to drive looper and knife mechanisms by using eccentric cams 5, as well as powering backing fabric and yarn drives by variable pulleys which are not shown, or by other conventional means, all of which are well known in the art. These drive mechanisms are usually contained in the end cabinet 6 of the tufting machine. Of primary concern to the present invention is the rocker shaft 7 mounted below and substantially parallel to the main driveshaft 4. A stroke adjustment means is provided, such as the illustrated embodiment of an eccentric cam s secured preferably adjacent to each end of the driveshaft 4, which rotates thereby, and imparts longitudinal motion to an eccentric rod 9 which is engaged in the arcuate slot of a drive lever 10 affixed to the rocker shaft 7. The stroke adjustment means is illustrated in isolation in FIG. 5.

Figure 4:
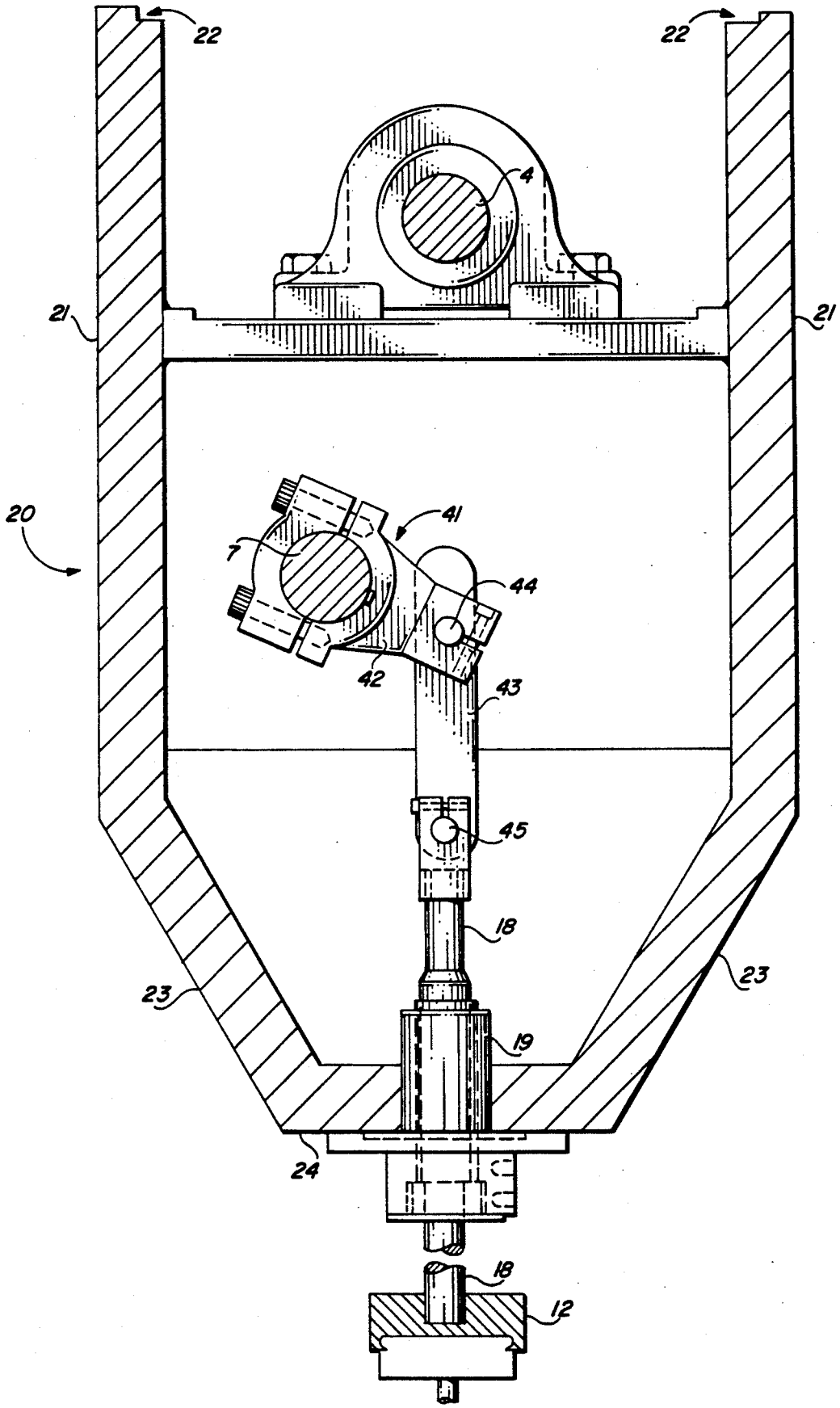
FIG. 4 is a partial sectional view taken generally along the line 4—4 of FIG. 3.

Referring now to FIG. 4, rocking motion applied to the rocker shaft 7 is imparted by a linkage to the needlebar 12 so that the needlebar moves reciprocally. The illustrated mechanism depicts the rocker shaft 7 rotatably mounted in bearings 14 on crossbeams 16 (both shown in FIG. 3) in the head 20 of the tufting machine. For each push rod 18 there is a rocker arm 41 having a split end clamped to the rocker shaft 7. The rocker arm 41 extends radially from the rocker shaft 7 to provide a crank arm 42 having a split end conventionally connected to a connecting link 43 by wrist pin 44 journaled in the top of the link 43. A similar wrist pin 45 may connect the lower end of the link to the upper end of the push rod 18. There are usually eight or more of these push rods 18 in a four meter tufting machine. The rocking motion of the rocker shaft 7 thus effects a reciprocating motion to the push rods 18 which are driven through guide bearings 19 and hence drive the needlebar 12. In the preferred embodiment, the rocker arms 41 are mounted on the rocker shaft 7 so that they extend radially in a substantially opposite direction to the drive lever 10 (shown in FIG. 5). In this manner the drive lever and needle drive mechanism move in opposition to one another and thereby reduce the vibration during operation of the machine.

In the preferred embodiment shown in FIG. 4, the driveshaft 4 and rocker shaft 7 are mounted in a high speed tufting machine head 20. As illustrated, the head 20 is suitable to permit conventional yarn feeding devices such as those described in U.S. Pat. Nos. 4,864,946 and 4,870,915 (not shown) to be mounted on one or both sides of the head. The head 20 has a pair of opposed vertically disposed spaced parallel walls 21 which are recessed at the top 22 to support a coverplate 25 (shown in FIG. 3). A pair of downwardly converging lower plates 23 support by their lower edges a horizontally extending bottom plate 24. Guide bearings 19 are mounted in the bottom plate 24 to slideably retain the push rods 18.

To change the depth of the pile height produced by a tufting machine, it is necessary to change the length of the stroke of the needle. In the stroke adjustment means illustrated in FIG. 5, the eccentric 8 is mounted on the driveshaft 4 and the eccentric strap 63 is engaged on the eccentric. The needle stroke may be varied by merely repositioning a bolt 51 connecting the eccentric rod 9 to the drive lever 10 within the arcuate slot 50. This changes the amplitude of oscillation of the drive lever 10 and effects a corresponding change in the amplitude of rooking of the rocker shaft 7. The closer along the arcuate slot 50 that the bolt 51 is adjusted to the rocker shaft 7, the greater the amplitude of oscillation and the longer the needle stroke. Other alternative stroke adjustment means such as the adjustable eccentric drive illustrated in U.S. Pat. No. 4,834,005 are well known in the art.

Figure 5:
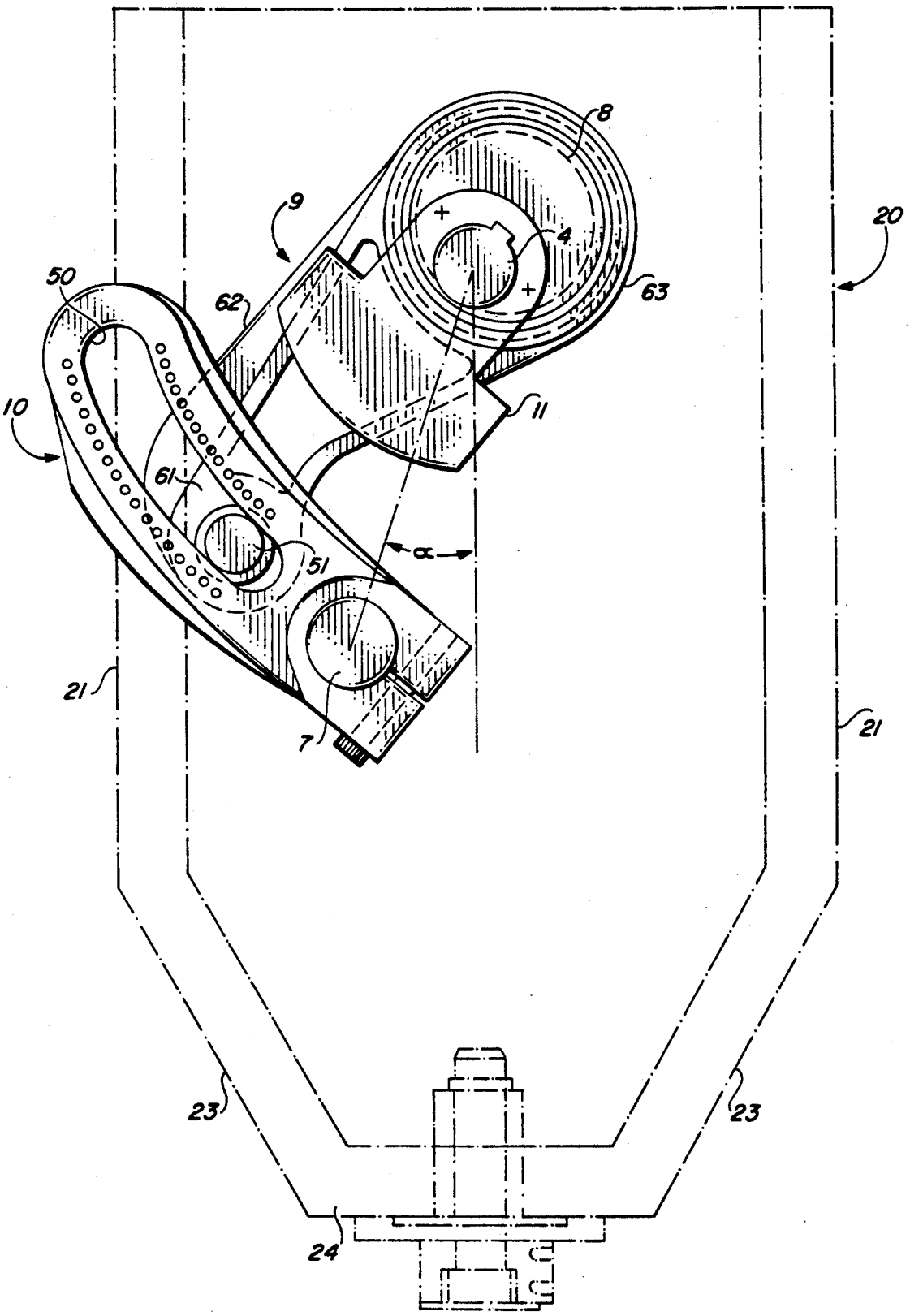
FIG. 5 is a partial sectional view taken generally along the line 5—5 of FIG. 3.

Continuing to FIG. 5, the driveshaft 4 is mounted substantially central to the parallel walls 21 of the high speed head 20 and above the rocker shaft 7. Although the position of the driveshaft 4 within the head 20 may be varied somewhat, it should retain sufficient clearance from any wall or plate of the head to allow the conventional mounting of counterweights 17 (shown in FIG. 3). In the preferred construction the placement of the driveshaft 4 is such that the angle $\alpha$ is less than 30°. Accordingly, the driveshaft 4 is less than 30° from the vertical with respect to the rocker shaft 7.

Figure 6:
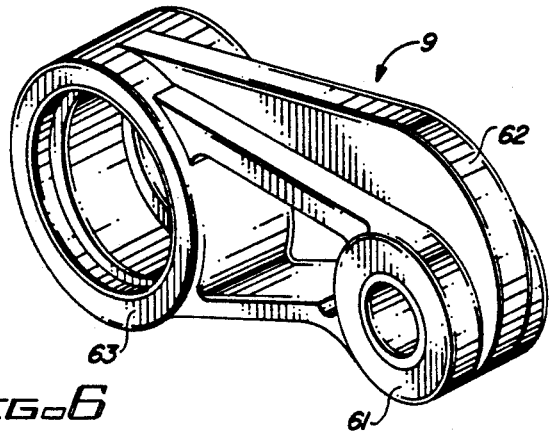
FIG. 6 is a perspective view of an embodiment of a strengthened eccentric rod.

In the preferred embodiment shown in isolation in FIG. 6, the eccentric rod 9 that imparts motion to the drive lever 10 is strengthened near the wrist 61 which connects to the drive lever 10. The preferred strengthening consists of reinforcing the margin 62 of the eccentric rod 9 opposite the rocker shaft 7 and proximate the wrist.

Numerous alterations of the structure herein disclosed will suggest themselves to those skilled in the art. It will be understood that the details and arrangements of the parts which have been described and illustrated in order to explain the nature of the invention are not to be construed as any limitation of the invention. All such alterations which do not depart from the spirit of the invention are intended to be included within the scope of the appended claims.

What is claimed herein is:

1. A tufting machine which comprises:

(a) a head;

(b) a driveshaft rotatably mounted in the head and operatively connected to a power source for rotatably driving said driveshaft;

(c) a rocker shaft rotatably mounted parallel and below the driveshaft in the head of the tufting machine such that a line formed by connecting the driveshaft to the rocker shaft is less than 30° from a vertical plane passing axially through the driveshaft;

(d) a stroke adjustment means connecting the driveshaft to the rocker shaft;

(e) a push rod connected to the rocker shaft and driven reciprocally thereby; and (f) a needle bar connected to the push rod and driven reciprocally thereby.

2. The invention according to claim 1 in which the head has two substantially vertical side walls, each of said side walls having an inner surface and an outer surface, wherein a vertical plane passing axially through the driveshaft is disposed approximately equidistant from the inner surfaces of the side walls of the head of the tufting machine.

3. The invention according to claim 1 in which a conventional yarn feeding device is mounted on at least one side of the head of the tufting machine.

4. The invention according to claim 1 in which the stroke adjustment means comprises an adjustable eccentric mounted on the drive shaft and an eccentric rod mounted on said adjustable eccentric and connecting to a drive lever affixed to the rocker shaft, where the drive lever extends radially from the rocker shaft.

5. The invention according to claim 4 in which a rocker arm affixed to the rocker shaft is in linkage with the needlebar and said rocker arm extends radially from the rocker shaft in a direction substantially opposite from the drive lever.

6. A tufting machine comprising:

(a) a head;

(b) a driveshaft rotatably mounted in the head and operatively connected to a power source for rotatably driving said driveshaft;

(c) an eccentric fixed to the driveshaft;

(d) an eccentric rod with a wrist and an eccentric strap, with said strap being mounted upon the eccentric and by which oscillating motion is communicated to the eccentric rod;

(e) a drive lever with an arcuate slot fixably engaging the wrist of the eccentric rod, and to which oscillating motion is thereby communicated;

(f) a rocker shaft upon which the drive lever is fixed, where said rocker shaft is rotatably mounted parallel to and below the driveshaft in the head of the tufting machine such that a line formed by connecting the driveshaft and the rocker shaft is less than 30° from a vertical plane passing axially through the driveshaft; and (g) a needle bar in linkage with the rocker shaft and driven reciprocally thereby.

7. The invention according to claim 6 in which the linkage between the needle bar and the rocker shaft comprises a rocker arm affixed to the rocker shaft such that the rocker arm extends radially from the rocker shaft in a direction substantially opposite the drive lever.

8. The invention according to claim 5 in which the eccentric rod is reinforced proximate its wrist on the margin opposite the rocker shaft.

* * * * *